US008844655B2

(12) United States Patent
Crane

(10) Patent No.: US 8,844,655 B2
(45) Date of Patent: Sep. 30, 2014

(54) DRILL STRING TOOLING JOINT

(75) Inventor: Robert F. Crane, Oconomowoc, WI (US)

(73) Assignee: Earth Tool Company, LLC, Oconomowoc, WI (US)

( * ) Notice: Subject to any disclaimer, the term of this patent is extended or adjusted under 35 U.S.C. 154(b) by 467 days.

(21) Appl. No.: 13/187,094

(22) Filed: Jul. 20, 2011

(65) Prior Publication Data

US 2012/0018221 A1 Jan. 26, 2012

Related U.S. Application Data

(60) Provisional application No. 61/365,961, filed on Jul. 20, 2010.

(51) Int. Cl.
*E21B 10/26* (2006.01)
*E21B 17/04* (2006.01)

(52) U.S. Cl.
USPC ..... 175/325.2; 175/325.6; 175/325.7; 175/344; 175/406

(58) Field of Classification Search
CPC ..... E21B 7/28; E21B 10/26
USPC ..... 177/325.2, 325.6, 325.7, 344, 406, 394
See application file for complete search history.

(56) References Cited

U.S. PATENT DOCUMENTS 8,365,841 B2 2/2013 Dimitroff
2006/0060384 A1* 3/2006 Michael ..... 175/53
2009/0250266 A1* 10/2009 Dimitroff ..... 175/53
2010/0012379 A1* 1/2010 Wentworth et al. ..... 175/53
2010/0044113 A1* 2/2010 Leblanc et al. ..... 175/325.2

OTHER PUBLICATIONS

Railhead Underground Products, LLC, "Railhead Endurance Dirt Reamers", Page from website, 2002-2006.

* cited by examiner

*Primary Examiner* — Brad Harcourt
(74) *Attorney, Agent, or Firm* — Tomlinson Rust McKinstry Grable

(57) ABSTRACT

A joint connecting a pair of members rotatable about a common axis end to end includes a first member having a threaded end portion and a non-circular exterior surface rearwardly of the threaded end portion, a second member having a threaded socket wherein the threaded end portion of the second member can be engaged, and a non-circular exterior surface, a ground engagement sleeve having a non-circular profile on an inner surface thereof whereby the sleeve can be slidably mounted on the non-circular exterior profiles of the first and second members when such profiles are brought into alignment by rotation of one member relative to the other in a manner effective to pass torque from one member to the other by means of the non-circular profiles, a first pair of alignable holes in the sleeve and first member to receive a fastener to secure the sleeve to the first member and a hole in the second member penetrating the threaded socket and positioned to receive a fastener to secure the second member to a third member in place of the first member, the third member having a hole in a threaded end portion thereof alignable with the hole in the second member.

25 Claims, 5 Drawing Sheets

DRILL STRING TOOLING JOINT

CROSS-REFERENCE TO RELATED APPLICATIONS

This application claims priority to U.S. Provisional Patent Application No. 61/365,961, filed Jul. 20, 2010, the contents of which are incorporated fully herein by reference.

FIELD OF THE INVENTION

The invention relates to rotary boring and, in particular to an improved joint for connecting two rotatable components of a boring system.

SUMMARY OF THE INVENTION

The present invention is directed to a pipe joint for use in rotary boring operations. The pipe joint comprises a first member, a second member, and a ground engaging member. The first member has a non-circular exterior surface and a threaded socket. The second member comprises a threaded end portion for mating engagement with the threaded socket and a non-circular exterior surface portion corresponding to the non-circular exterior surface of the first member. The ground engaging member has a non-circular internal surface and an outer surface for enlarging a borehole. The non-circular internal surface corresponds to the non-circular exterior surface of both the first member and the second member for slidably mounting the ground engaging member on the non-circular exterior surfaces of the first member and the second member when the threaded socket of the first member is engaged with the threaded end portion of the second member and to transmit torque between the first member and the second member. Alignable holes are formed in the ground engaging member and the second member for receiving a fastener to secure the ground engaging member to the second member.

The present invention is further directed to a rotary boring system comprising a rotary machine, a drill string, and a downhole tool. The drill string has a first end and a second end. The first end is operatively connected to the rotary drive machine to drive rotation of the drill string. The downhole tool comprises a first member, a second member, and a ground-engaging member. The first member is connected to the second end of the drill string and comprises a non-circular exterior surface and a connector socket. The second member comprises a connector portion for mating engagement with the connector socket and a non-circular exterior surface portion corresponding to the non-circular exterior surface of the first member. The ground engaging member has a non-circular internal surface and an outer surface for enlarging a borehole. The non-circular internal surface corresponds to the non-circular surface of both the first member and the second member for slidably mounting the ground engaging member on the non-circular surfaces of the first member and the second member when the connector end portion is engaged with the connector socket and to transmit torque between the first member and the second member. The downhole tool further comprises alignable holes in the ground engaging member and the second member for receiving a fastener to secure the ground engaging member to the second member.

Further still, the present invention is directed to a method for making boreholes using a boring machine having a rotary drive system capable of rotating and axially advancing or retracting a downhole tool attached to a drill string. The method comprises the steps of connecting a first end of an elongate first member to the drill string, wherein the first member comprises a first end and a second end, the second end comprising a socket and a non-circular outer surface. A ground engaging member having a correspondingly non-circular internal surface is slid over the second end of the first member. A second member is engaged to the socket of the first member and oriented such that a non-circular surface formed thereon fits within the non-circular internal surface of the ground engaging member to pass rotation of the drill string and the first member to the ground engaging member and the second member by means of the non-circular surfaces.

Still yet, the present invention is directed to an adapter for connecting a pair of drilling components. The adapter comprises a first member, a second member, and a ground engaging member. The first member has a non-circular exterior surface and threaded socket. The second member has a threaded end portion and a non-circular exterior surface rearward of the threaded end portion. The threaded end portion is engagable with the threaded socket of the first member. The ground engaging member has a non-circular profile on an inner surface thereof whereby the ground engaging member is slidably mounted on the non-circular exterior profiles of the first and second members when such profiles are brought into alignment by rotation of one member relative to the other in a manner effective to pass torque from one member to the other by means of the non-circular profiles.

The present invention is further directed to a pipe joint for use in rotary boring operations. The pipe joint comprises a first member, a second member, and a ground engaging member. The first member has a non-circular exterior surface and a first connector. The second member comprises a second connector for mating engagement with the first connector and a non-circular exterior surface portion corresponding to the non-circular exterior surface of the first member. The ground engaging member has a non-circular internal surface and an outer surface for enlarging a borehole. The non-circular internal surface corresponds to the non-circular exterior surface of both the first member and the second member for slidably mounting the ground engaging member on the non-circular exterior surfaces of the first member and the second member when the first connector is engaged with the second connector and to transmit torque between the first member and the second member.

DESCRIPTION OF THE INVENTION

Rotary boring systems for making holes through soil are well known. The boring system generally includes drill string comprising a series of drill pipes joined end to end. The drill string is rotated by a rotary drive machine and pushed or pulled through the ground by means of a powerful hydraulic device such as a hydraulic cylinder or a gear rack actuated by a hydraulic motor. A boring head for boring in soil, rock or both is disposed at the end of the drill string and may include an ejection nozzle for water or other drilling fluid to assist in boring. In other applications, tools such as pipe bursters, impactors, slitters and pullers are used to slit, burst and replace existing underground pipelines. Reamers may be used along or in combination with any of the aforementioned tools to upsize a borehole.

In most horizontal boring operations a pilot bore is drilled between a starting point and an end point. Once the boring tool reaches the end point, whether the surface of the ground or a pit, the boring tool is removed and a backreamer may be attached to the drill string. The backreamer is used to upsize the borehole to meet or slightly exceed the outer diameter of the product pipe towed into the bore during pullback. Easy attachment of the product pipe to a backreamer assembly in a small access pit is disclosed in U.S. Patent application number 2002/0112890, the contents of which are incorporated herein by reference. If attempting to make a switch out in a pit, the swap will require enlargement of the access pit lengthwise to accommodate the length of the backreamer and its connection components. Ideally, the operator would like the change of tools to occur rapidly and be easily accomplished without the need to dig a large access pit. The present invention allows an operator to change tools at the downhole end of a drill string in a small access pit.

Figure 1:
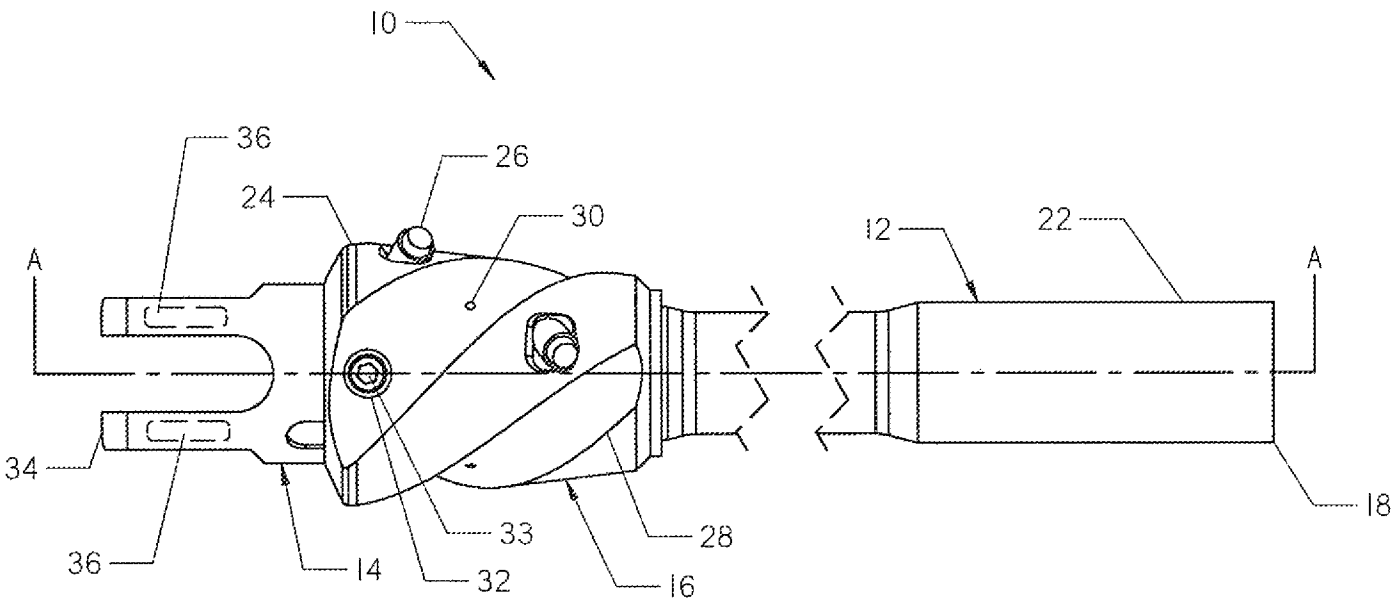
FIG. 1 is a side view of a first pipe joint according to the invention including a first member, a pulling adapter, and a ground engaging member.
Figure 2:
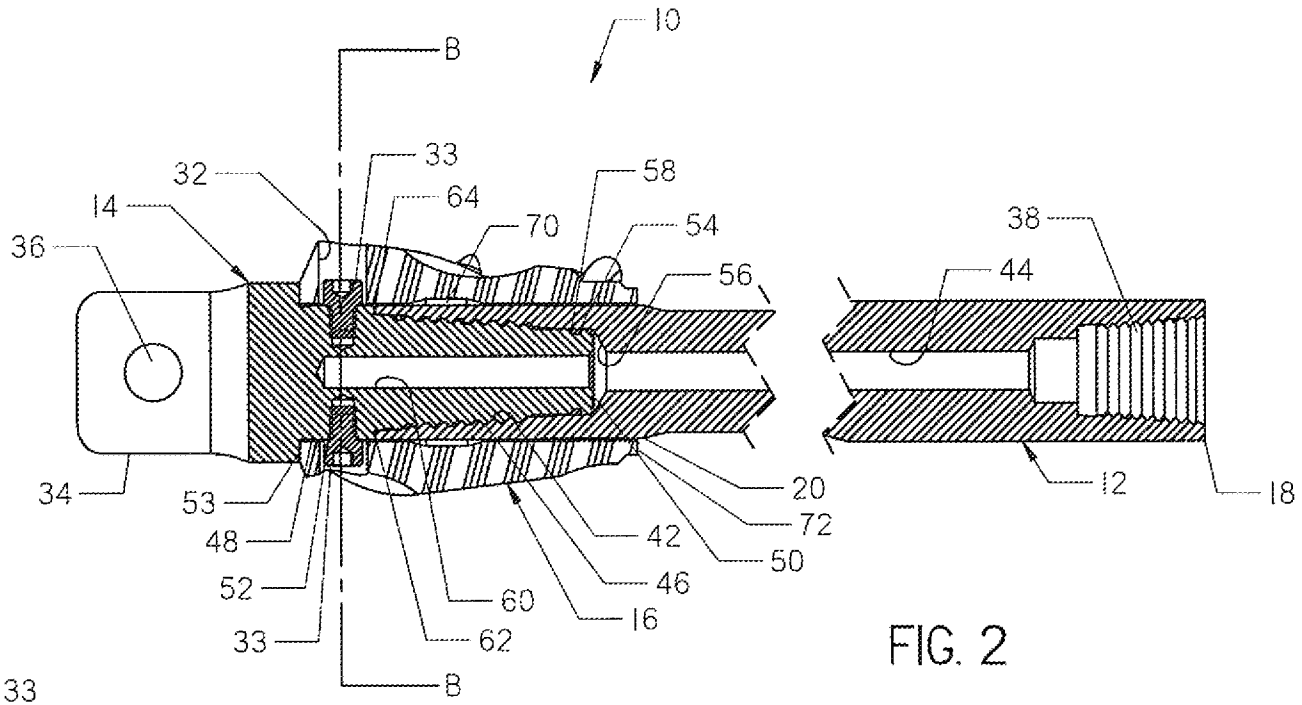
FIG. 2 is a longitudinal section view along line A-A of FIG. 1.

Turning now to the figures and specifically to FIG. 1, there is shown therein a pipe joint 10 of the present invention. As used herein the term "pipe joint" may mean a downhole tool used in rotary boring operations, an adapter used to connect various drilling tools to the downhole end of a drill string, or the connection of two drilling system components. The pipe joint 10 of FIG. 1 comprises a first member 12, a second member 14, and a ground engaging member 16. The first member 12 has a first end 18 and a second end 20 (FIG. 2). The first end 18 of the first member 12 may have a diametral upset 22 for a yet to be described purpose. The second end 20 of the first member 12 may be disposed within the ground engaging member 16.

The ground engaging member 16 shown in FIG. 1 comprises a frustoconical outer surface 24 having a plurality of carbide cutting teeth 26 and a helical groove 28. A plurality of orifices 30 may be spaced about the outer surface 24 to eject fluid from the member into the borehole. The ground engaging member 16 further comprises alignable holes 32 used to connect the ground engaging member to either the first member 12 or the second member 14 using a fastener 33. In FIG. 1 the alignable holes 32 are shown positioned to connect the ground engaging member to the second member 14. The second member 14 will be discussed in more detail hereinafter, but as shown in FIG. 1 the second member may comprise a clevis 34 formed for receiving any generic connection to a swivel and product pulling device as may be required to install a utility in the borehole. Cross holes 36 formed in the clevis are on a common axis to allow use of a pin or bolt (not shown) to carry shear forces during towing of the utility behind the pipe joint 10.

Turning now to FIG. 2, there is shown a longitudinal section view of the pipe joint 10 of FIG. 1 along section line A-A. The first member 12 may be elongate and comprise the first end 18 having coupling member 38 for coupling the first member to the drill string (not shown). The second end 20 of the first member 12 may comprise a non-circular exterior surface 40 (FIG. 4) and a first connector comprising a threaded socket 42. The first connector 42 and non-circular exterior surface 40 may form an upset at the second end 20 of the first member 12. Likewise, the coupling member 38 may form an upset 22 at the first end 18 of the first member 12. A fluid passage 44 may extend from the first end 18 to the second end 20 to carry fluid such as drilling mud to the ground engaging member 16.

The second member 14 comprises a second connector, depicted as a threaded end portion 46 for mating engagement with the first connector 42. When threads are used, as shown in FIG. 2, the first member 12 and second member 14 are rotated relative to each other to matingly engage the threaded end portion 46 of the second member 14 within the threaded socket 42 of the first member 12. One skilled in the art will appreciate that the first connector 42 and second connector 46 may include any conventional coupling or joint used to connect drilling tools and may comprise part of such a tool. One such coupling system is known commercially as Splinelok™ wherein interlocking splines that pass torque from the drill string to a tool is described in Wentworth et al., published U.S. Patent Application Serial No. 2001/0017222, the disclosure of which is incorporated herein by reference for all purposes.

As illustrated, the second connector 42 is a tapered threaded end portion disposed between a central collar 48 and a front face 50 of the second member 14. The second member 14 also comprises a hole 52 that is alignable with a corresponding hole 32 in ground engaging member 16. Alignable holes 52 and 32 allow the second member to be locked in position relative to the ground engaging member 16 with fastener 33. A first stop member 53 is formed on the second member 14 to abut the ground engaging member 16 and defines a first boundary of the central collar 48. A second stop member 62 defines a second boundary of the central collar 48 and abuts a front face 64 of the first member 12.

An O-ring 54 may be positioned adjacent front face 50 of the second member 14 and against a wall 56 of the first member 12 in a groove 58. The O-ring 54 protects the socket 42, wall 56 and threads 46 from ingress of abrasive materials that would exacerbate wear during operations. The O-ring 54 also prevents the egress of drilling fluid as it passes from passage 44 into passage 60 formed in the second member 14. A radial passage 65 is formed in the second member 14 allow fluid to flow from the internal passage 60 into the cross-sectional clearance area 68 (FIG. 3) to a circumferential gallery 70. The fluid then flows through the discharge ports 30 (FIG. 1) to mix with the soil thereby facilitating the ground engagement operation. The cross-sectional clearance area 68 continues forward for the length of the ground engaging member 16 and a fraction of the fluid delivered will flow to the front end 72 of the ground engaging member to reduce wear on the edge when engaged with the soil. Carbide teeth 26 and the tapered helical groove 28 produce shearing and mixing between soil and drill fluid as the drill string and ground engaging member are rotated.

Figure 3:
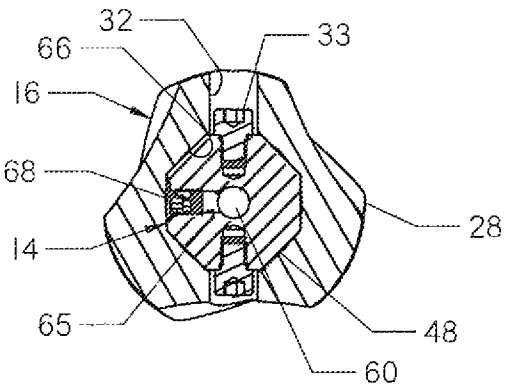
FIG. 3 is a cross section view of the device of FIG. 2 along section line B-B showing details of engaged non-circular profiles.

FIGS. 2 and 3 illustrate the ground engaging member 16 comprises a non-circular internal surface 66 positioned over the central collar 48 of the second member 14. The outer surface 24 may be frustoconical for enlarging the borehole. The non-circular internal surface 66 corresponds to the non-circular exterior surface 40 (FIG. 4) of the both the first member 12 and the second member 14 for slidably mounting the ground engaging member 16 on the non-circular exterior surfaces of the first member and the second member when the first connector 42 is coupled to the second connector 46 to transmit torque between the first member 12 and the second member 14.

In operation, joint 10 is assembled by sliding ground engaging member 16 over the first member 12. Threaded end portion 46 of second member 14 is then screwed into threaded socket 42 and tightened to the desired level. After threaded end portion 46 of second member 14 has been tightened to the desired degree in threaded socket 42, the alignment of exterior surfaces 48 and 40 is checked. If the profiles of the non-circular exterior surfaces 48 and 40 are not aligned ground engaging member 16 will not slide over second member 14, consequently, the second member is unscrewed or backed off until the profiles of exterior surfaces 48 and 40 are aligned. The ground engaging member 16 is then slid along first member 12 and over non-circular exterior surface 48 of the second member 14. In the event that the profiles of exterior surfaces 48 and 40 are not aligned when second member 14 is tightened to the desired level, the degree to which the second member will have to be backed off or loosened to align the profiles depends upon the selected profile. For example, in the case of an octagonal profile, the angle between the centers of each flat surface is 360/8 or 45°. Thus, in case of octagonal profile, the maximum number of degrees that second member 14 may have to be backed off after tightening to align the octagonal profiles of exterior surfaces 48 and 40 is the rotational difference between successive surfaces, or 45°.

After the ground engaging member has been positioned over the second member 14, a retaining bolt or screw 33 is passed through hole 32 in the ground engaging member and engaged with bolt hole 52 in the second member, locking the ground engaging member onto the second member. Shoulder 53 prevents the ground engaging member 16 from sliding rearward as ground engagement forces are applied. Bolts 33 retain ground engaging member 16 should the normal direction of the drill string be reversed. Preferably, one or more of alignable holes 52 and 32 and bolt 33 are provided with NPT (National Pipe Thread) threads which provide improved retention and greater shear area than convention straight threads.

Continuing in FIGS. 2 and 3, fluid such as drilling mud is passed along central bore 44 of first member 12, continuing flow into internal passage 60 of the second member 14. The fluid will then pass through the wall of the second member 14 through radial passage 65. The flow rate of such fluid may be metered through an orifice formed in passage 65. Threading of passage 65 helps to maintain the position of the orifice so as not to maintain offset between the orifice and the inner surface of the ground engaging member 16. After flowing through passage 65, the fluid may make its way through a cross sectional clearance 68 along the length of the ground engaging member to the circumferential gallery 70. Finally, the fluid flows through the discharge port 30 (FIG. 1) to mix with the soil thereby facilitating the ground engagement operation. The sectional clearance may continue forward for the length of the ground engaging member and a fraction of the fluid delivered will flow to the front end 72, thereby reducing wear on this edge when engaged with the soil.

Figure 4:
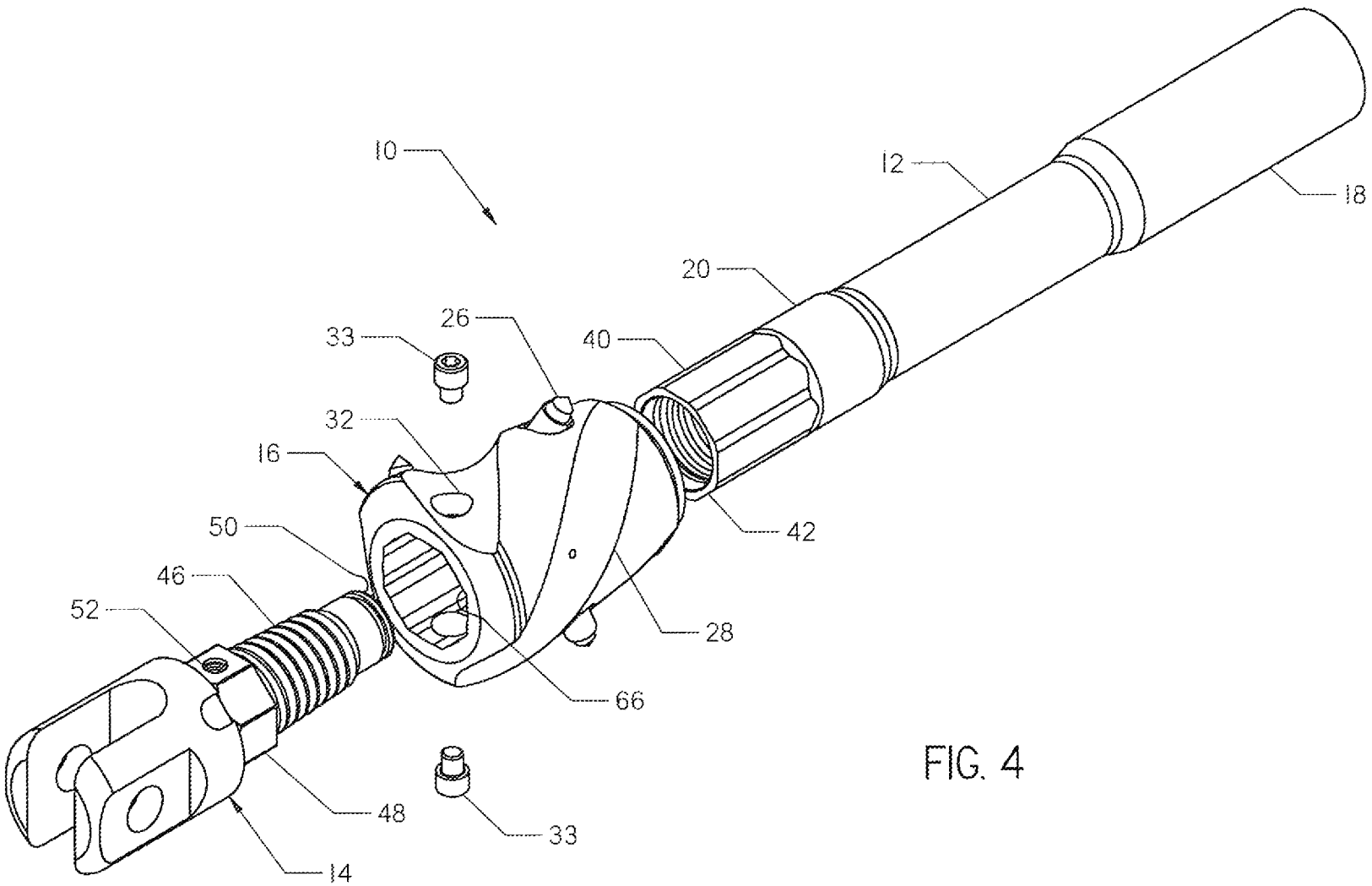
FIG. 4 is an isometric view of the pipe joint of FIGS. 1-3 in exploded view.

Turning now to FIG. 4, an embodiment of the pipe joint of the present invention is shown in exploded view. First member 12 comprises an elongate tubular member having a first end 18 and a second end 20. The first end 18 has an upset 22 having a threaded connector 38 (FIG. 2) for connecting the first member to the drill string (not shown). The second end 20 may comprise the non-circular exterior surface 40 and a connector socket. The second member 14 comprises the connector portion for mating engagement with the connector socket 42 and a non-circular surface 48 corresponding to the non-circular exterior surface 40 of the first member 12. The second member 14 may comprise a front face 50 and a central collar formed by the non-circular exterior surface 48. The connector end portion 46 is disposed between the front face 50 and the central collar.

The ground engaging member 16 comprises a frustoconical backreaming member having a plurality of helical grooves 28 and carbide teeth 26 for enlarging the borehole. The ground engaging member 16 comprises a non-circular internal surface that corresponds to the non-circular exterior surfaces of the first member and the second member for slidably mounting the ground engaging member on the non-circular surfaces of the first member and the second member when the connector end portion 46 is engaged with the connector socket 42. Such connection allows for the transmission of torque between the first member and the second member.

Alignable holes 32 and 52 are formed in the ground engaging member 16 and the second member 14 receive fasteners 33 to secure the ground engaging member 16 to the second member 14. One skilled in the art will appreciate that alignable holes may alternatively be formed in the first member to secure the ground engaging member to the first member instead of the second member or in addition to the holes formed in the second member.

Figure 5:
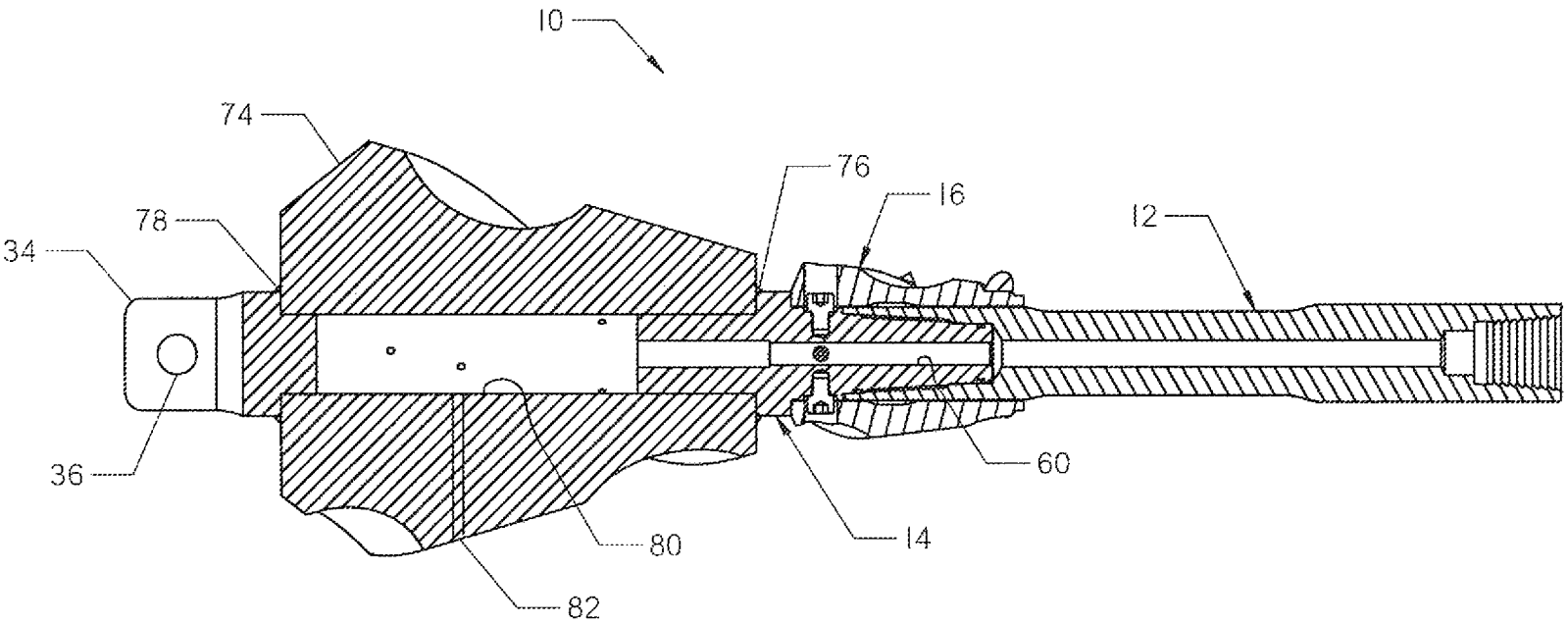
FIG. 5 is a side view of the device shown FIGS. 1-3 having an additional backreaming tool in a stacked arrangement to provide progressive upsizing.

FIG. 5 demonstrates a use of the pipe joint of the present invention with an alternative large reamer weldment 74 sized to continue ground engagement work to open the bore while permitting fluid flow from the ground engagement member 16 as well as ports 82 formed in the exterior surface of the reamer 74. Reamer 74 may be joined to the second member 14 by a weld 76. A product pipe (not shown) is towed at product connector 34 behind the combination of stacked reamers. Connector 34 is joined to reamer 74 by weld 78. As shown in FIG. 5, the fluid flow passage of the second member 14 may continue, in fluid communication with internal passage 80 formed in reamer 74 so that fluid may be injected into the borehole from the reamer through radial ports 82 formed in the reamer.

Figure 6:
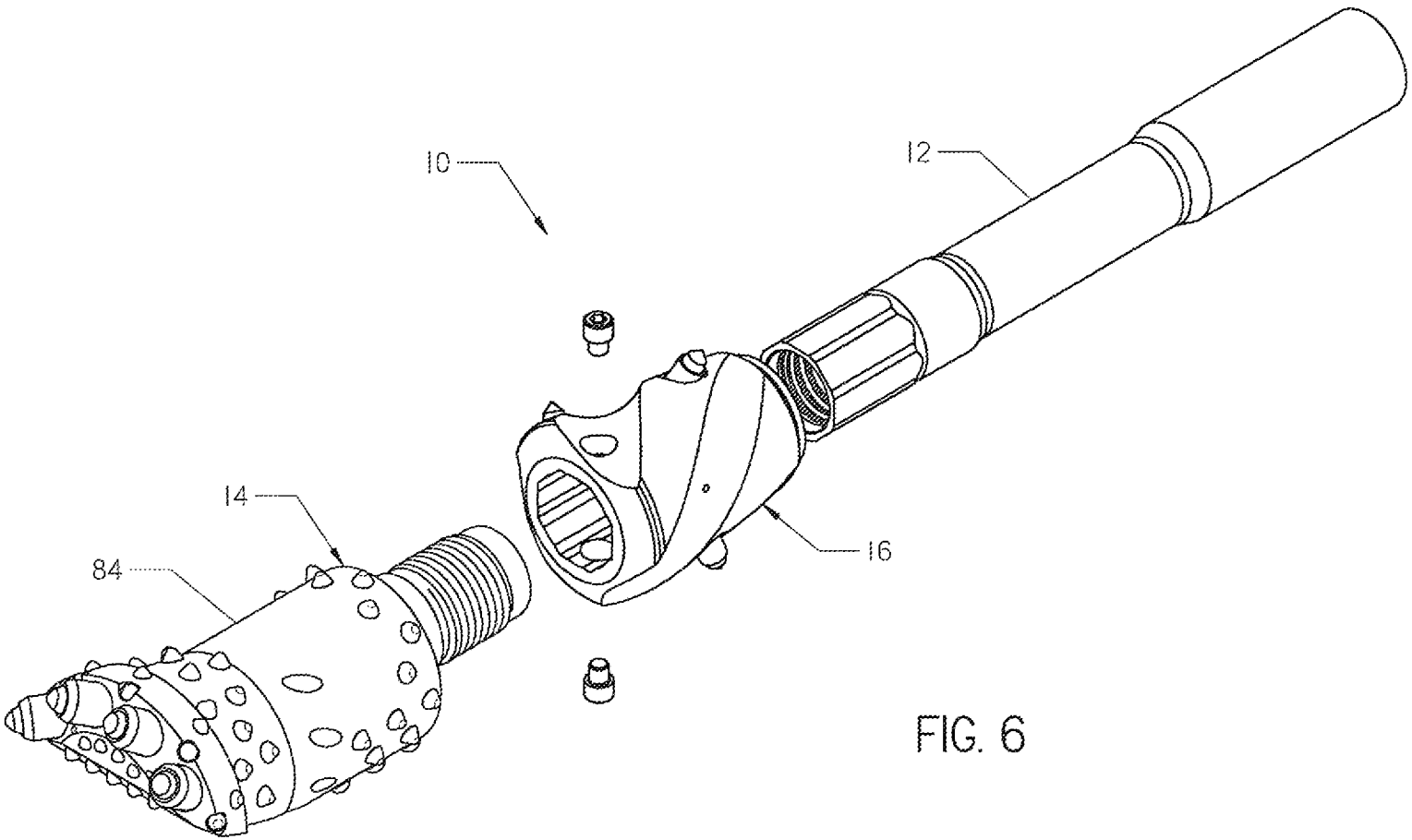
FIG. 6 is an isometric view of the device of the present invention showing a boring tool connected to the first member.

Turning now to FIG. 6, a downhole tool constructed in accordance with the present invention is shown. The downhole tool comprises the previously described first member 12, second member 14 and ground engaging member 16 of FIGS. 1-5. However, the second member 14 of FIG. 6 comprises a boring tool 84. The boring tool 84 shown in FIG. 5 comprises a directional drill bit commonly used in horizontal drilling operations. One skilled in the art will appreciate the second member 14 may comprise several different boring tools used either to cut a pilot bore or to upsize the borehole and tow in product pipe.

In the method for making boreholes in accordance with the present invention, a boring machine having a rotary drive system capable of rotating and axially advancing or retracting a downhole tool attached to a drill string is used. The method comprises connecting the first end 18 of the first member 12 to the drill string. The first member 12 may be connected to the drill string by rotating the first member in a first direction to thread the first member 12 to the drill string. The ground engaging member 16 is slid over the second end 18 of the first member 12 so that the non-circular exterior surface 40 of the first member is positioned with the interior non-circular surface 66 of the ground engaging member. The non-circular surfaces 40 and 66 may comprise a geometric profile. For purposes of illustration only, an octagonal profile will be described. The octagonal profiles of the first member and the ground engaging member 16 are aligned before sliding the ground engaging member over the second end 20 of the first member.

The second member 14 is engaged to the socket 42 of the first member 12 and the second member is oriented, by rotation, such that the non-circular surface 66 of the second member fits within the ground engaging member 16 to pass rotation of the drill string and the first member to the ground engaging member and the second member. The second member 14 may comprise a threaded end portion 46 and the socket 42 may comprise corresponding threads. The method comprises threading the threaded end portion into the socket until the external non-circular surface of the second member is adjacent to the ground engaging member. The second member may then be rotated slightly to align the external non-circular surface 48 with the internal non-circular surface of the ground engaging member. The ground engaging member 16 is then moved axially to substantially cover the external non-circular surface of the second member. The holes 32 and 52 are aligned and the fastener 33 is inserted into the holes to fasten the second member 14 to the ground engaging member 16.

As will be appreciated, the joint of the invention is applicable to a variety of applications wherein tools used in horizontal directional drilling are connected to a drill string. Joints in accordance with the invention are particularly useful in coupling drill bits, sonde housings, reamers, back reamers, starter rods, impactors and similar drilling tools to a drill string or together in a manner that facilitates rapid replacement of such components while simultaneously providing joints and couplings with an increased usable lifetime and enhanced reliability.

Various modifications can be made in the design and operation of the present invention without departing from the spirit thereof. Thus, while the principal preferred construction and modes of operation of the invention have been explained in what is now considered to represent its best embodiments, as herein illustrated and described, it should be understood that the invention may be practiced otherwise than as specifically illustrated and described.

What is claimed is:

1. A pipe joint for use in rotary boring operations, the pipe joint comprising:

a first member having a non-circular exterior surface and a threaded socket;

a second member comprising a threaded end portion for mating engagement with the threaded socket and a non-circular exterior surface portion corresponding to the non-circular exterior surface of the first member; and a ground engaging member having a non-circular internal surface and an outer surface for enlarging a borehole, the non-circular internal surface corresponds to the non-circular exterior surface of both the first member and the second member for slidably mounting the ground engaging member on the non-circular exterior surfaces of the first member and the second member when the threaded socket of the first member is engaged with the threaded end portion of the second member and to transmit torque from the first member and the second member to the ground engaging member;

a fluid passage formed by an internalin the first member and an internal passage in the second member;

a radial extending passage formed in the second member, having an opening formed in the non-circular exterior surface portion of the second member, to guide fluid from the internal passage of the second member to outside the second member; and alignable holes in the ground engaging member and the second member for receiving a fastener to secure the ground engaging member to the second member.

2. The pipe joint of claim 1 wherein the first member comprises an elongate tubular member having a first end and a second end, wherein the first end is operatively connected to a drill string and the second end comprises the non-circular exterior surface and the threaded socket.

3. The pipe joint of claim 1 wherein the non-circular surfaces of the first member, the second member and the ground engaging member are all geometrically shaped surfaces having substantially the same geometric profile.

4. The pipe joint of claim 1 wherein the non-circular surfaces comprise a pattern of lengthwise splines and grooves.

5. The pipe joint of claim 1 wherein the second member comprises a front face and a central collar, wherein the threaded end portion is disposed between the front face and the central collar, and wherein the central, collar comprises the external non-circular surface.

6. The pipe joint of claim 5 wherein the second member comprises:

a first stop member defining a first boundary of the central collar; and a second stop member defining a second boundary of the central collar;

wherein the first stop member abuts the ground engaging member and the second stop member abuts a front face of the first member.

7. The pipe joint of claim 1 comprising a plurality of radially extending passages fotuied in the ground engaging member, in fluid communication with the radially extending passage of the second member, to eject fluid from the ground engaging member.

8. The pipe joint of claim 1 wherein the outer surface of the ground engaging member is frustoconical and comprises a plurality of carbide cutting members and a helical groove.

9. The pipe joint of claim 1 wherein the non-circular surfaces are octagonal.

10. The pipe joint of claim 1 wherein the second member comprises a connector for towing a product pipe.

11. A method for making boreholes using a boring machine having a rotary drive system capable of rotating and axially advancing or retracting a downhole tool attached to a drill string, the method comprising the steps of:

connecting a first end of an elongate first member to the drill string, wherein the first member comprises a first end and a second end, the second end comprising a socket and a non-circular outer surface;

sliding a ground engaging member having a correspondingly non-circular internal surface over the second end of the first member;

engaging a second member to the socket of the first member and orienting the second member such that a non-circular surface formed thereon fits within the non-circular internal surface of the ground engaging member to pass rotation of the drill string and the first member to the ground engaging member and the second member by means of the non-circular surfaces; and running a fluid through the drill string into an internal passage formed by the first member and the second member and into and a radial extending passage formed in the non-circular exterior surface of the second member to guide the fluid outside the second member.

12. The method of claim 11 wherein connecting the first end to the drill string comprises rotating the first member in a first direction to thread the first member to the drill string.

13. The method of claim 11 wherein the first member comprises an external non-circular surface, wherein both the non-circular internal surface of the ground engaging member and the external non-circular surface of the, first member comprise an octagonal profile, the method further comprising the step of aligning the octagonal profiles of the first member and the ground engaging member before sliding the ground engaging member over the second end of the first member.

14. The method of claim 13 wherein the second member comprises a threaded end portion and the socket comprises threads, the method further comprising:

threading the threaded end portion into the socket until the external non-circular surface of the second member is adjacent to the ground engaging member.

15. The method of claim 14 wherein the external non-circular surface of the second member comprises an octagonal profile, the method further comprising:

rotating the second member until the external non-circular surface of the second member is aligned with the internal non-circular surface of the ground engaging member;

moving the ground engaging member axially to substantially cover the external non-circular surface of the second member;

aligning a set of holes in the ground engaging member with a corresponding set of holes in the second member; and inserting a fastener in the aligned holes to fasten the second member and ground engaging member.

16. An adapter for connecting a pair of drilling components, the adapter comprising:

a first member having a non-circular exterior surface and a threaded socket;

a second member having a threaded end portion and a non-circular exterior surface rearward of the threaded end portion wherein the threaded end portion is engagable with the threaded socket of the first member;

a fluid passage formed by an internal passage in the first member and an internal passage in the second member;

a radial extending passage formed in the second member, having an opening formed in the non-circular exterior surface portion of the second member, to guide fluid from the internal passage of the second member to outside the second member; and a ground engaging member having a non-circular profile on an inner surface thereof whereby the ground engaging member is slidably mounted on the non-circular exterior profiles of the first and second members when such profiles are brought into alignment by rotation of one member relative to the other in a manner effective to pass torque from one member to the other by means of the non-circular profiles.

17. The adapter of claim 16 wherein each of the non-circular surfaces has an geometric profile.

18. The adapter of claim 16 wherein the second member comprises a boring tool.

19. The adapter of claim 16 wherein the first member comprises an elongate tubular member having a first end and a second end, wherein the first end is operatively connectable to a drill string and the second end comprises the non-circular exterior surface and the threaded socket.

20. The adapter of claim 16 wherein the non-circular surfaces are all geometrically shaped surfaces having substantially the same geometric profile.

21. The adapter of claim 16 wherein the non-circular surfaces comprise a pattern of lengthwise splines and grooves.

22. The adapter of claim 16 wherein the second member comprises a front face and the non-circular exterior surface comprises a central collar, wherein the threaded end portion is disposed between the front face and the central collar.

23. The adapter of claim 16 wherein the outer surface of the ground engaging member is frustoconical and comprises a plurality of carbide cutting members and a helical groove.

24. The adapter of claim 16 further comprising alignable holes in the ground engaging member and second member for receiving a fastener to secure the ground engaging member to the second member.

25. The adapter of claim 16 further comprising alignable holes formed in both the ground engaging member and the first member for receiving a fastener to secure the ground engaging member to the first member.

* * * * *

UNITED STATES PATENT AND TRADEMARK OFFICE

CERTIFICATE OF CORRECTION

PATENT NO. : 8,844,655 B2
APPLICATION NO. : 13/187094
DATED : September 30, 2014
INVENTOR(S) : Crane It is certified that error appears in the above-identified patent and that said Letters Patent is hereby corrected as shown below:

In the Claims,

Column 7, line 56, please delete the word "internalln" and substitute therefor --internal passage in--.

Column 8, line 25, please delete the word "fotuied" and substitute therefor --formed--.

Signed and Sealed this
Sixteenth Day of December, 2014

Michelle K. Lee

Michelle K. Lee
*Deputy Director of the United States Patent and Trademark Office*